US009945209B2

(12) United States Patent
Farrow

(10) Patent No.: US 9,945,209 B2
(45) Date of Patent: Apr. 17, 2018

(54) PLUNGER ASSEMBLY WITH EXPANDABLE SEAL

(71) Applicant: James T. Farrow, Grand Prairie, TX (US)

(72) Inventor: James T. Farrow, Grand Prairie, TX (US)

( * ) Notice: Subject to any disclaimer, the term of this patent is extended or adjusted under 35 U.S.C. 154(b) by 222 days.

(21) Appl. No.: 14/705,941

(22) Filed: May 6, 2015

(65) Prior Publication Data

US 2016/0326841 A1 Nov. 10, 2016

(51) Int. Cl.
*E21B 37/10* (2006.01)
*E21B 43/12* (2006.01)

(52) U.S. Cl.
CPC ..... *E21B 37/10* (2013.01); *E21B 43/121* (2013.01)

(58) Field of Classification Search
CPC ..... E21B 37/00; E21B 37/04; E21B 37/045; E21B 43/12; E21B 43/121; E21B 43/122
USPC ..... 166/68, 105
See application file for complete search history.

(56) References Cited

U.S. PATENT DOCUMENTS 9,109,424 B2 8/2015 Jefferies
2003/0155117 A1* 8/2003 Gray ..... E21B 43/121 166/107
2006/0065390 A1 3/2006 Amies et al.
2009/0038796 A1 2/2009 King
2014/0246209 A1* 9/2014 Themig ..... E21B 43/14 166/374
2014/0262204 A1 9/2014 Farris
2016/0108710 A1* 4/2016 Hightower ..... E21B 43/121 166/372
2016/0168963 A1 6/2016 Roycroft

OTHER PUBLICATIONS

Office Action in related U.S. Appl. No. 14/745,096, dated May 16, 2017, 14 pages.
Office Action in related U.S. Appl. No. 14/745,142, dated May 16, 2017, 16 pages.
Office Action in related U.S. Appl. No. 14/980,112, dated Aug. 22, 2017, 13 pages.
Office Action in related U.S. Appl. No. 14/702,651, dated May 5, 2017, 15 pages.

* cited by examiner

*Primary Examiner* — D. Andrews
*Assistant Examiner* — Yanick A Akaragwe
(74) *Attorney, Agent, or Firm* — Law Office of Jeff Williams; J. Oliver Williams

(57) ABSTRACT

The present application includes and assembly having a hollowed body configured to traverse the length of a well bore and remove contaminants. The hollowed body having an upper seal body and a lower seal body. Each body including a seat for securing and sealing by a dart. The dart is configured to transition between the seats by passing through a central channel of the hollowed body. The assembly further includes an expandable seal configured to expand in diameter from the increase in pressure in the well bore. The expandable seal contacts the walls of the well bore. The expandable seal cleans the walls of the well bore and prevents leakage of working fluid between the walls and the assembly.

18 Claims, 4 Drawing Sheets

PLUNGER ASSEMBLY WITH EXPANDABLE SEAL

BACKGROUND

1. Field of the Invention

The present application relates generally to oil field devices and, more particularly, to a plunger assembly with an expandable seal.

2. Description of Related Art

The oil and gas industry has been drilling holes and removing natural crude oil for decades. Wells contain any number of contaminants, particulates, and water along with the gas/oil being sought. If water is not removed, pressure of the hydrostatic head of water in the surface tubing will become greater than that of the bottom hole pressure, thereby essentially sealing the formation and shutting in the well. Gas cannot on its own pressure typically flow to the surface.

Plungers are downhole tools used by operators to remove contaminants and water from productive natural gas wells. A plunger acts as an artificial lift. In operation the plunger passes down through the well until it reaches a contact point, at which point, potential energy of the plunger falling in the well acts to partially restrict the flow of working fluid through the plunger. Pressure beneath the plunger builds and raises the plunger in the well, thereby pushing out the liquids and contaminants above the plunger.

Typical plunger lift systems are inefficient partly due to the design constraints placed upon tool designers. A major limitation placed upon tool designers are the design constraints related to tubing tolerances within the well bore itself. Tubes come in different diameters (tolerance variation) and in set lengths (i.e. 30-34 feet). Tubing tends to not be perfectly straight, round, or have the exact same internal diameter. Variations in tubing internal diameters and at junction points between tubes result in a term called "drift diameter". The drift diameter is the minimum inside diameter of the tube in order to pass a ridged tool of some set length through it. Tools are designed to have a maximum diameter no greater than the drift diameter of the tubing. This results in the tools having a gap between them and the ID of the tubing. The large annulus or gap between the tool and the tubing that the tools passes through are why tools tend to be inefficient because plunger lift tools work on a pressure gradient between fluid beneath the tool and fluid above the tool. Leaks between the tool and tubing impact the pressure gradient.

Another disadvantage of conventional plunger lift systems are the particulates (i.e. sand) in the working fluid. The working fluid passes within the gap between the plunger lift system and the casing at increased speeds resulting in tools abrading quickly. Additionally, the leak leads to turbulence created around the down hole edge of the tool when it expands after passing through the leak. A new plunger lift assembly tool is required to minimize abrading and that corrects for the constraints associated with the drift diameter.

Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
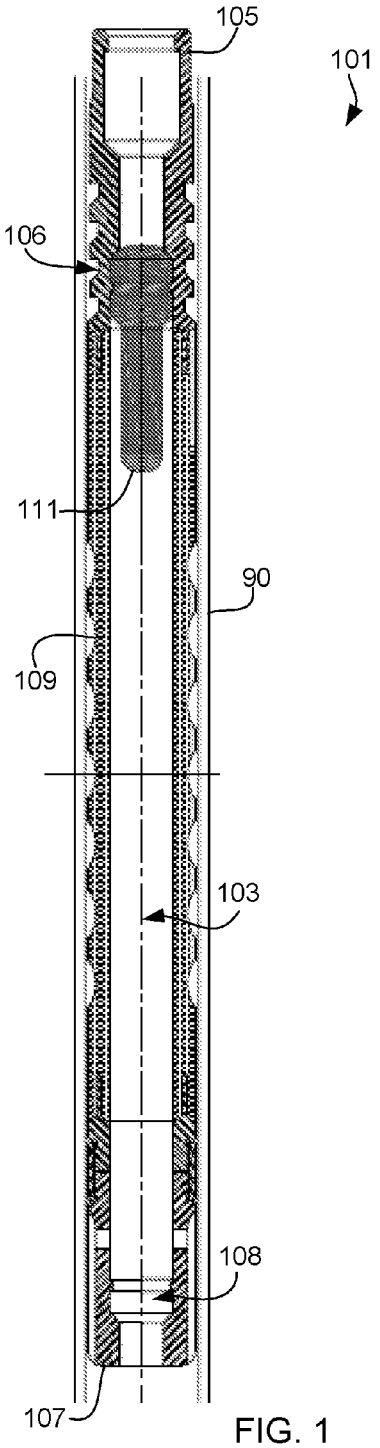
FIG. 1 is a side section view of a plunger assembly in a well bore according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional plunger lift systems. Specifically, the assembly of the present application is configured to provide an expandable seal configured to selectively expand as a result of pressure built up below the assembly. The pressure expands the expandable seal to contact the walls of the well bore. Fluid pressure raises assembly with the expandable seal in contact with the walls. The expandable seal rubs against the walls as the assembly is raised to the surface. As the pressure gradient in the well decreases and the assembly is permitted to fall, the expandable seal retracts in size smaller than the drift diameter of the well bore. The expandable seal creates a seal against the walls of the well bore to eliminate leakage past the assembly. The expandable seal also acts to stabilize the assembly in the well bore. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The plunger assembly of the present application is illustrated in the associated drawings. The assembly includes a hollowed body including an upper seal body, a lower seal body, and an expandable seal coupled together. A central channel passes through each body and the expandable seal to permit the translation of a dart within the hollowed body. The dart regulates the flow of working fluid through the hollowed body by engaging an upper seat and a lower seat located in the upper seal body and the lower seat body, respectively.

Figure 2:
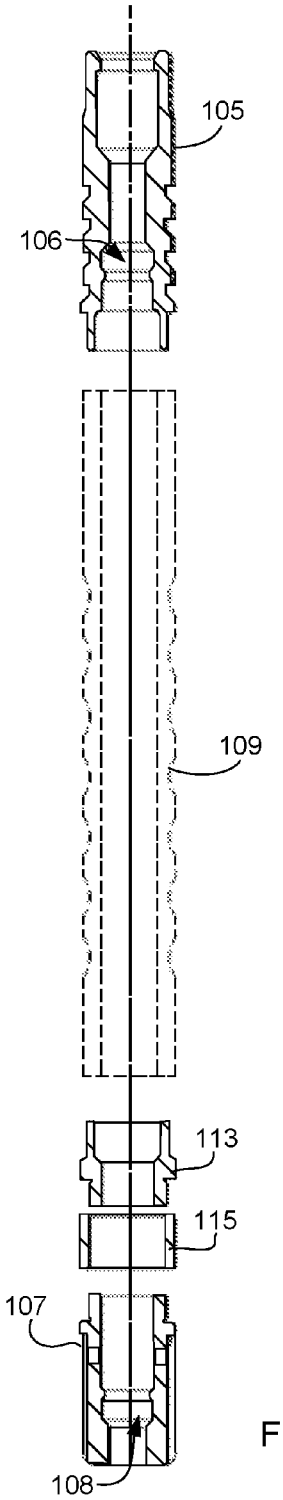
FIG. 2 is a an exploded side section view of a hollowed body of the plunger assembly of FIG. 1.

Referring now to the drawings wherein like reference characters identify corresponding or similar elements in form and function throughout the several views. FIGS. 1 and 2 illustrate plunger assembly 101. Assembly 101 includes a hollowed body having a central channel 103. The hollowed body includes an upper seal body 105, a lower seal body 107, and an expandable seal 109. Assembly 101 also includes a dart 111 configured to selectively translate within the central channel 103 between an upper seat 106 and a lower seat 108, respectively located in upper seal body 105 and lower seal body 107. Assembly 101 is configured to translate within a well bore 90 between a raised top position and a lowered bottom position. The raised top position is located at the surface of the well bore while the lowered bottom position is located at the base of the well bore deep within the ground.

Figure 3:
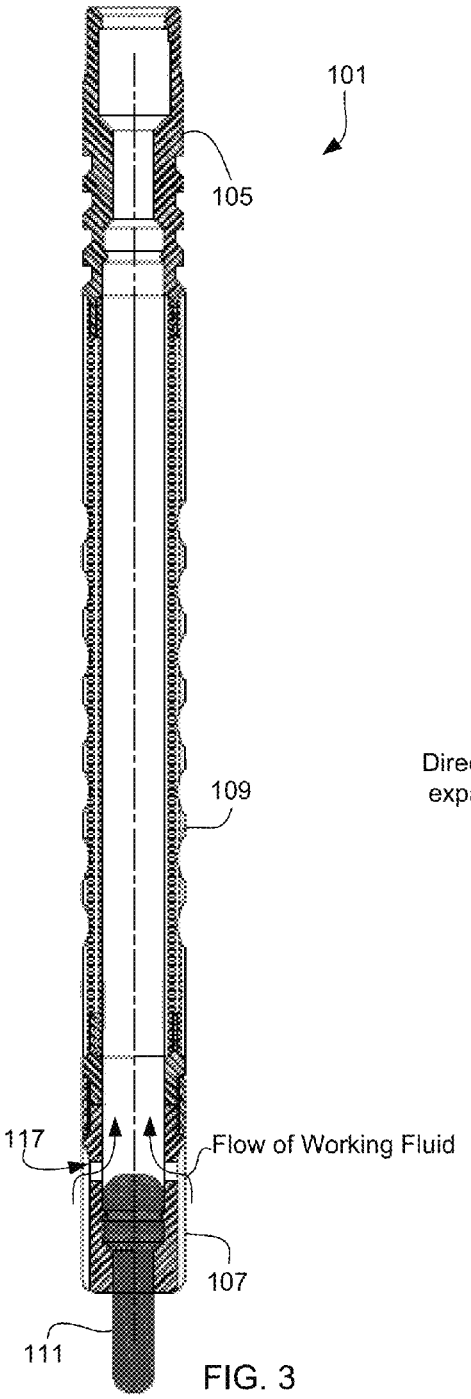
FIG. 3 is a side section view of the plunger assembly of FIG. 1 in a configuration to fall within the well bore.

Referring now also to FIG. 3 in the drawings, an exploded view of the hollowed body of assembly 101 is illustrated. In this figure, the individual portions and parts of the hollowed body are more clearly shown. Expandable seal 109 is located between upper seal body 105 and lower seal body 107. A lower seal connection 113 is coupled to an opposing end of seal 109, opposite from that of body 105. Seal 109 is coupled to upper seal body 105 at one end and a lower seal connection 113 at an opposing end. Mechanical and/or chemical methods may be used to releasably bond expandable seal 109 to body 105 and connection 113. A coupling 115 is used to couple lower seal body 107 to connection 113. Mechanical methods, such as threaded connections or welding, may be used to secure them together. It is important to note that seats 106 and 108 are located within bodies at opposing ends of seal 109. Therefore, dart 111 is configured to pass through seal 109 to engage seats 106 and 108.

Figure 4:
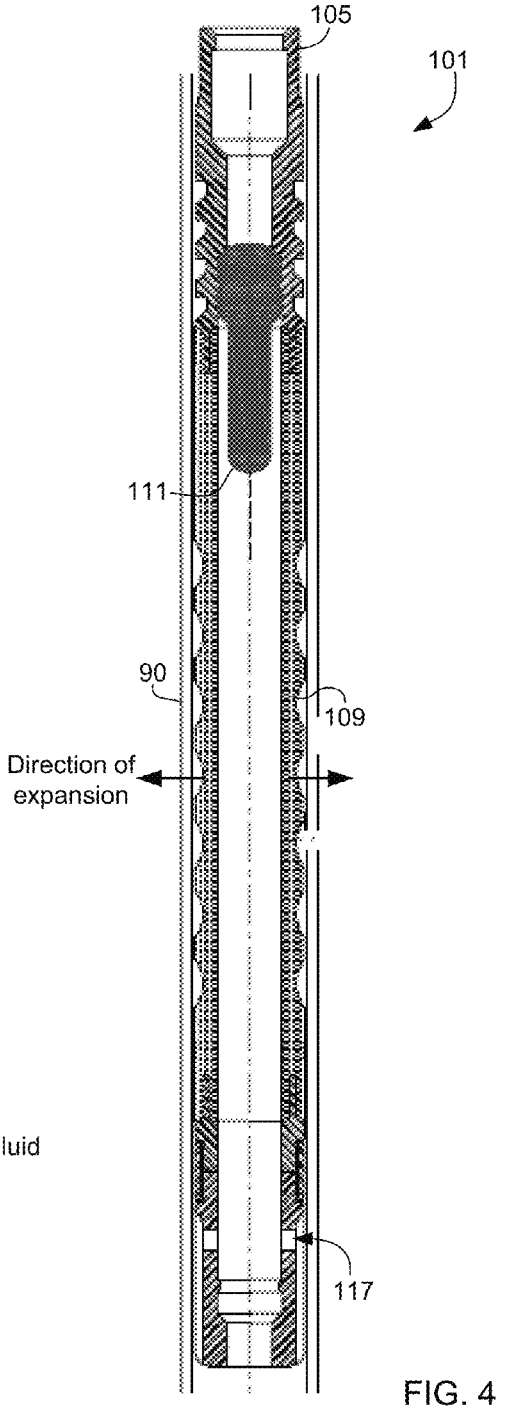
FIG. 4 is a side section view of the plunger assembly of FIG. 1 in a configuration to rise within the well bore.
Figure 6:
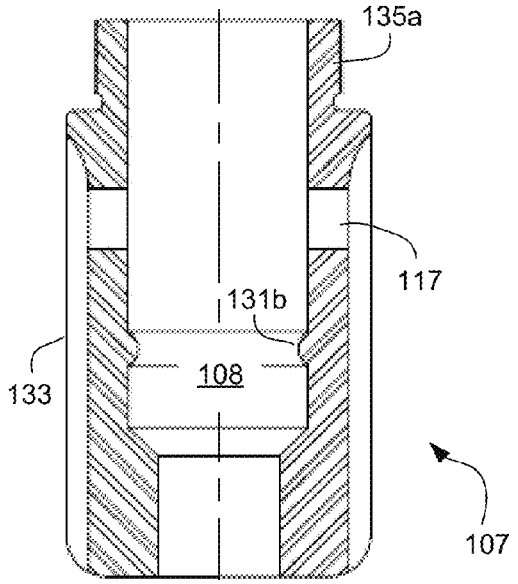
FIG. 6 is a side section view of a lower seal body in the plunger assembly of FIG. 1.

Referring now also to FIGS. 3 and 4 in the drawings, assembly 101 is illustrated in two configurations, a falling configuration (FIG. 3) and a rising configuration (FIG. 4). The difference between the configurations is the location of dart 111. In FIG. 3 fluid is permitted to pass through central channel 103 by locating dart 111 in lower seat 108. Lower seal body 107 includes one or more ports 117 to allow working fluid to flow through assembly 101. The passage of working fluid permits assembly 101 to fall toward the lower bottom end of the well bore. Dart 111 is configured to contact a stop at the bottom of the well bore and disengage from seat 108, pushing dart 111 above seat 108 into the path of flow of working fluid through port 117. The flow of working fluid passing through port 117 pushes dart 111 through seal 109 and to seat 106 where dart 111 contacts a portion of upper seal body 105 thereby creating a seal. The seal causes pressure to increase below dart 111. The pressure build up increases until it is sufficient to seat dart 111 in seat 106. This position is seen in FIG. 4.

As seen in FIG. 4, dart 111 is located in seat 106. Pressure that seated dart 111 continues to increase. A pressure gradient builds up between working fluid above seal body 105 and the working fluid within channel 103 and below seal body 107. Increased pressure within channel 103 expands seal 109 outward as directed in FIG. 4. Seal 109 contacts the walls of well bore 90 and creates a seal against the wall. The pressure gradient increases until it becomes large enough to begin lifting assembly 101 within well bore 90. While raising to the surface, seal 109 rubs along the walls. When assembly 101 reaches the surface, a striker rod contacts dart 111 and dislodges it from seat 106 and reseats it into seat 108. Pressure within channel 103 decreases and seal 109 reduces in diameter to a measurement within the drift diameter.

Working fluid within well bore 90 contains a number of contaminants, debris, particulates, oils, and so forth that can be abrasive and damaging to objects and tools. Even the casing of well bore 90 itself can be affected adversely over time. There are many advantages of having seal 109 contact the walls of well bore 109, some of them are as follows: (1) Seal 109 rubs and scrapes the walls clean when rising in well bore 90. This serves to prolong the life of the casing and maintain the integrity of well bore 90. (2) Scale buildup decreases the relative diameter of well bore 90 leading to potential clogging of tools. Seal 109 maintains the drift diameter of well bore 90. (3) Seal 109 creates a seal against the walls that prevents the passage of working fluid (leakage). Therefore, creating the seal reduces abrading. (4) Contact between expandable seal 109 and the walls increase stabilization of assembly 101 within well bore 90.

It is understood that there is a balance between the hardness and flexibility of seal 109. Seal 109 is hard enough to provide sufficient abrasion to the walls of well bore 90 but yet is flexible enough to expand at a pressure level lower than is necessary to lift assembly 101. Seal 109 is configured to have sufficient flexibility to accommodate variations in well bore diameter.

Figure 5:
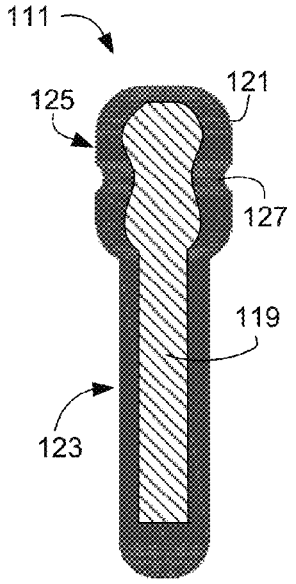
FIG. 5 is a side section view of a dart in the plunger assembly of FIG. 1.

Referring now also to FIG. 5 in the drawings, an enlarged side section view of dart 111 is illustrated. Dart 111 includes a core member 119 and a wear resistant coating 121. Coating 121 is made from a type of flexible elastomeric/polyurethane material that permits good wear resistance to contaminants within the working fluid. Dart 111 is subjected to abrasive conditions due to the working fluid. Dart 111 is partly unique in that it includes coating 121 as a protection to abrasive damage. Coating 121 is also configured to compress when under pressure. Compression of coating 121 occurs when entering and exiting seats 106 and 108. Coating 121 also provides some cushioning effect at impact with the striker rod and the stop. Core member 119 is a solid metallic member. Core member 119 is not limited to being without a hollowed interior or being made from metallic materials. Other embodiments are contemplated. Dart 111 is configured to have a cylindrical shaft 123 and a bulbous upper end 125 with a radial groove 127 around the perimeter. Groove 127 is configured to coincide with corresponding ribs 131*a* and 131*b* in seats 106 and 108.

Referring now also to FIGS. 6-9, detailed enlarged views of bodies 105 and 107 along with connection 113 and coupling 115 are illustrated. A side section view of lower seal body 107 is show in FIG. 6. Ports 117 are located above seat 108. Rib 131*b* is shown within seat 108 for engaging groove 127 of dart 111. Slots 133 are shown more clearly in FIG. 6 and are configured to ease entrance of working fluid into ports 117.

Figure 7:
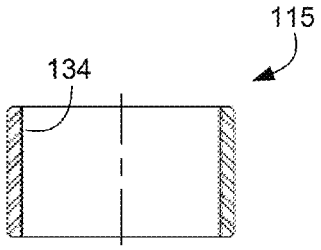
FIG. 7 is a side section view of a coupling in the plunger assembly of FIG. 1.

With respect to FIG. 7, coupling 115 is a threaded coupling having internal threads 134. The threads of coupling 115 engage matching threads 135*a* and 135*b* on lower seal body 107 and connection 113, respectively. As noted previously, other methods of attachment are contemplated. Threaded connections are only one exemplary method that may be used.

Figure 8:
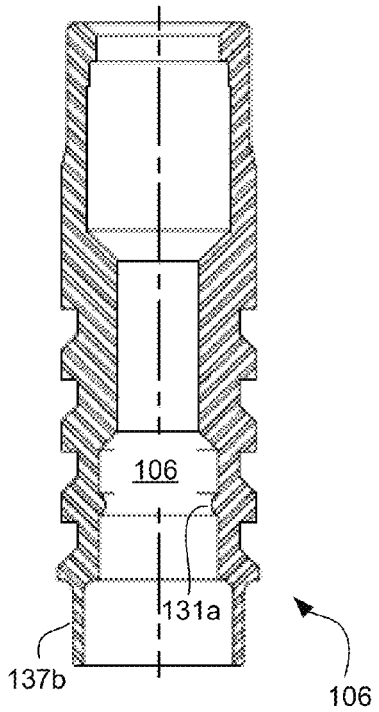
FIG. 8 is a side section view of an upper seal body in the plunger assembly of FIG. 1.
Figure 9:
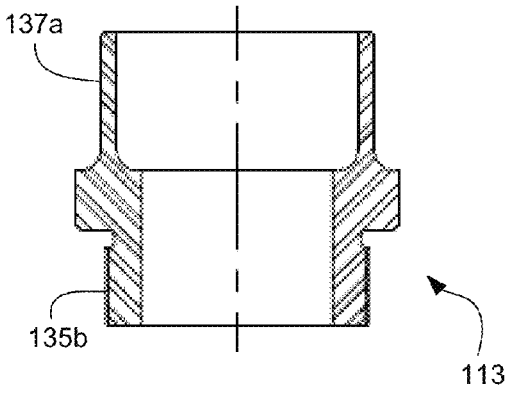
FIG. 9 is a side section view of a lower seal connection in the plunger assembly of FIG. 1.

With respect to FIG. 9, connection 113 is illustrated as having threads 135*b* and a flange 137*a*. Flange 137*a* is used to provide sufficient surface and support to releasably couple expandable seal 109. As seen in FIG. 8, upper seal body 105 also includes a flange 137*b* to provide sufficient surface and support for expandable seal 109. As stated previously, mechanical and/or chemical methods may be used to attach seal 109 to flanges 137*a* and 137*b*. The releasable feature is important as seal 109 will wear over time. Seal 109 may be removed and replaced as necessary. This feature allows for the reuse of bodies 105 and 107 along with connection 113 and coupling 115. Also noted in FIG. 8 is rib 131*a* to engage groove 127.

The current application has many advantages over the prior art including at least the following: (1) an expandable seal to press against the walls of the well bore and create a seal; (2) the expandable seal expands as a result of increased pressure below the assembly; (3) the expandable seal cleans and improves the integrity of the well casing; (4) the expandable seal prevents leakage of working fluid between the assembly and the walls of the well bore; (5) the dart is set into the upper seat by increased fluid pressure; and (6) the expandable seal is interchangeable.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A mechanically operated plunger assembly for removing contaminants within a well bore, comprising:

an upper seal body having an upper seat;

a lower seal body having a lower seat;

a singular expandable seal coupled to the upper seal body and the lower seal body, working fluid being permitted to selectively pass through a central channel within the upper seal body, the lower seal body and the expandable seal, the expandable seal being made of at least one of a flexible elastomeric and a flexible polyurethane, working fluid passing through the central channel pass in contact with inner surfaces of the expandable seal, the upper seal body, and the lower seal body; and a dart configured to transition through the central channel between the upper seat and the lower seat and selectively regulates the passage of working fluid within the central channel;

wherein the expandable seal is configured to selectively flex and expand so as to contact walls of the well bore when subjected to a pressure gradient.

2. The assembly of claim 1, wherein the expandable seal is releasably coupled to the upper seal body and the lower seal body.

3. The assembly of claim 1, wherein the diameter of the expandable seal expands and contacts the walls of the well bore when the dart is seated in the upper seal body.

4. The assembly of claim 1, wherein the contact between the expandable seal and the walls occur as the assembly rises within the well bore.

5. The assembly of claim 4, wherein the contact during rising removes deposits and scales from the walls.

6. The assembly of claim 4, wherein contact between the expandable seal and the walls of the well bore are configured to increase stabilization of the assembly within the well bore.

7. The assembly of claim 1, wherein the expansion of the expandable seal minimizes leakage of working fluid between the assembly and the well bore.

8. The assembly of claim 1, wherein the dart includes a core member and a wear resistant coating.

9. The assembly of claim 8, wherein the core member is a solid core.

10. The assembly of claim 8, wherein the wear resistant coating of the dart is configured to selectively compress when seating in the upper seat and the lower seat.

11. The assembly of claim 1, wherein pressure gradient within the well bore seats the dart in the upper seat.

12. A plunger assembly for removing contaminants within a well bore, comprising:

a hollowed body configured to traverse along the length of the well bore and remove contaminants and particulates within working fluid; and a singular expandable seal coupled to the hollowed body and configured to flex so as to increase in diameter when subjected to a pressure gradient within the well bore, so as to contact the walls of the well bore, contact between the expandable seal and the walls of the well bore produce a seal between the working fluid above the expandable seal and the working fluid below the expandable seal, such that when traversing the length of the well bore, the expandable seal rubs against the walls;

wherein the singular expandable seal is made of at least one of a flexible elastomeric and a flexible polyurethane; and wherein working fluid contacts and passes centrally through both the expandable seal and the hollowed body.

13. The assembly of claim 12, wherein the hollowed body includes an upper seal body and a lower seal body coupled to opposing ends of the expandable seal, the upper seal body having an upper seat and the lower seal body having a lower seat.

14. The assembly of claim 13, further comprising:

a dart configured to selectively transition through a central channel between the upper seat and the lower seat, the dart configured to selectively regulate the passage of working fluid within the central channel.

15. The assembly of claim 14, wherein the dart includes a core member and a wear resistant coating.

16. The assembly of claim 15, wherein the core member is a solid core.

17. The assembly of claim 15, wherein wear resistant coating of the dart is configured to selectively compress when seating in the upper seat and the lower seat.

18. The assembly of claim 1, wherein fluid pressure entering the central channel seats the dart in the upper seat.

* * * * *